US007740163B2

(12) United States Patent
Abshire et al.

(10) Patent No.: US 7,740,163 B2
(45) **Date of Patent: *Jun. 22, 2010**

(54) PUSH LOCK

(76) Inventors: Tony Joseph Abshire, 8417 Parc Perdue Dr., New Iberia, LA (US) 70560; Michael Louis Boudreaux, 123 Bramber Dr., Lafayette, LA (US) 70508; Brian K. Jambois, 2515a E. Grace. St., Richmond, VA (US) 23224

( * ) Notice: Subject to any disclaimer, the term of this patent is extended or adjusted under 35 U.S.C. 154(b) by 751 days.

This patent is subject to a terminal disclaimer.

(21) Appl. No.: 11/650,869

(22) Filed: Jan. 8, 2007

(65) Prior Publication Data

US 2007/0194094 A1 Aug. 23, 2007

Related U.S. Application Data

(63) Continuation of application No. 10/628,935, filed on Jul. 29, 2003, now Pat. No. 7,159,761.

(60) Provisional application No. 60/399,764, filed on Jul. 31, 2002.

(51) Int. Cl.
*B65D 5/10* (2006.01)
*B65D 90/08* (2006.01)

(52) U.S. Cl. ..... 229/157; 229/109; 229/156; 229/185

(58) Field of Classification Search ..... None
See application file for complete search history.

(56) References Cited

U.S. PATENT DOCUMENTS 1,546,601 A 7/1925 Morris
2,151,733 A 3/1939 Bonfield
2,361,603 A 10/1944 Cohen et al.
3,101,882 A 8/1963 Parker (Continued)

FOREIGN PATENT DOCUMENTS

FR 2643783 3/1989

*Primary Examiner*—Gary E Elkins
(74) *Attorney, Agent, or Firm*—Thomas W. Barnes, III; Thomas W. Ryan, III

(57) ABSTRACT

An end closure design for a paperboard container having four or more end panels that form the end closure hingedly joined respectively to four side panels connected to each other by parallel, spaced apart fold lines. Each of the hinged end panels has a straight free edge parallel the hinged edge and each free edge has two spaced apart notches of the same shape and size cut therein, each positioned the same distance from the parallel, spaced apart fold lines such that when the panels are folded over, a notch from each end panel interlocks with a notch from an adjacent end panel. An opposing two of the hinged end panels also include two diagonal score lines, each extending from an interior edge of the notches to the interior corner formed by the fold lines between the end closure panel and its respective side panel. To form the end closure, the end closure panels without the diagonal score lines are folded inwardly, then the end closure panels with the diagonal score lines are folded inwardly. Pressure is applied (by pushing) to the central portion of the two panels with score lines between the score lines to cause adjacent and overlapping notches to interlock to form the end closure. The resulting container has an end with a central open area and four interlocked notches at the open area's corners.

16 Claims, 5 Drawing Sheets

U.S. PATENT DOCUMENTS

| | | | |
|---|---|---|---|
| 3,178,096 | A | 4/1965 | Reeves et al. |
| 3,182,888 | A | 5/1965 | Chidsey, Jr. et al. |
| 3,297,230 | A | 1/1967 | Stegner |
| 3,302,853 | A | 2/1967 | Locke |
| 3,319,869 | A | 5/1967 | Ostwald |
| 3,539,090 | A | 11/1970 | Blasdell |
| 3,750,933 | A | 8/1973 | Nicolay |
| 3,792,810 | A | 2/1974 | Tingley, et al. |
| 4,105,153 | A | 8/1978 | Locke |
| 4,279,378 | A | 7/1981 | Jenkins |
| 4,428,499 | A | 1/1984 | Nauheimer |
| 4,502,624 | A | 3/1985 | Burrell |
| 4,996,833 | A | 5/1987 | Tanaka, et al. |
| 5,573,175 | A | 11/1996 | Straub et al. |
| 5,664,726 | A | 9/1997 | Opper |
| 6,076,730 | A | 6/2000 | Boutin et al. |
| 6,220,508 | B1 | 4/2001 | Wisser |

PUSH LOCK

RELATED APPLICATION

This application claims the benefit of U.S. Provisional Patent Application Ser. No. 60/399,764 filed Jul. 31, 2002, the disclosure of which is incorporated by reference herein.

TECHNICAL FIELD

This invention generally relates to collapsible, paperboard containers, and more particularly to cartons formed from a blank having foldable sections in which bottom panels of the foldable sections cooperate to engage each other through a locking mechanism to form a sturdy carton.

BACKGROUND OF INVENTION

It has been found that there is a need in the packaging industry for octagonal and rectangular shaped cartons that can be easily squared up on a pallet and that have easy locking bottom flanges or panels that are more resistant to tearing.

Locking mechanisms for closing the bottom of containers are well known in the packaging industry. In particular, bottom closure panels having combinations of notches and score lines have been used to provide many different variations of push-type end closure/locking mechanisms. See, for example, U.S. Pat. No. 3,539,090 to Blasdell, U.S. Pat. No. 3,101,882 to Parker, U.S. Pat. No. 2,361,603 to Cohen and U.S. Pat. No. 3,319,869 to Ostwald. The prior art devices attempt to solve the same general problem of closing and locking container bottom and/or top panels. However, each has a problem in utilization that makes it relatively unattractive to manufacture or use. For example, many of the prior art locking systems are not easily set up, have limited use dependent on the type and size of carton they are to be used on, and have problems with score memory or tearing of the flanges if not folded properly. In addition, many of the prior art locking mechanisms require added costs in materials or manufacture.

Accordingly, it is a broad object of this invention to provide an improved locking system for the bottom or top panels of a container or carton, which is inexpensive to produce, has application to a wide variety of cartons, and operates in a simple manner that allows a user to easily close and lock the end panels while reducing the risk of tearing and the negative effects of score memory.

SUMMARY OF INVENTION

In the present invention, these purposes as well as others which will be apparent are achieved generally by providing an inexpensive and easy to use and manufacture top or bottom panel locking system for use with any type of container including, but not limited to, polygonal shaped containers having four, eight or sixteen side panels. The container is formed from a blank having sections that are foldable along parallel fold lines, the number of sections and size of each section depending on the size and shape of the desired container. Each of the sections includes a side panel and a bottom panel foldably connected by a fold line arranged substantially perpendicular to the parallel fold lines separating each of the sections. The bottom panels may differ in size and shape depending on the size and shape of the desired container.

The bottom panels include a locking mechanism enabling the bottom panels to be folded into an interlocking relationship through the locking mechanism to provide a sturdy container. At least four of the bottom panels are each provided with at least two spaced apart notches arranged in the free ends thereof such that, when folded to form a carton, a notch from each bottom panel interlocks with a notch from an adjacent bottom panel to form a locking junction that secures the foldable sections into place. Each locking junction applies force in two directions, thus reducing the effects of folding and diagonal score memory as well as the chances of tearing the bottom panels. The notches are formed from cut lines in the outer or free edge of the bottom panels and have a generally rectangular shape with tapered sides. Two opposing bottom panels further include diagonal score lines extending from an interior edge of each notch to an outer corner formed by the intersection of the parallel fold lines and the perpendicular fold lines to facilitate interlocking of the notches. When folded and locked in place, the bottom panels leave an open space centrally located between all bottom panels.

BRIEF DESCRIPTION OF THE DRAWINGS

The following drawings are illustrative of the invention and are not intended to limit the scope of the invention.

DETAILED DESCRIPTION OF PREFERRED EMBODIMENTS

Figure 1:
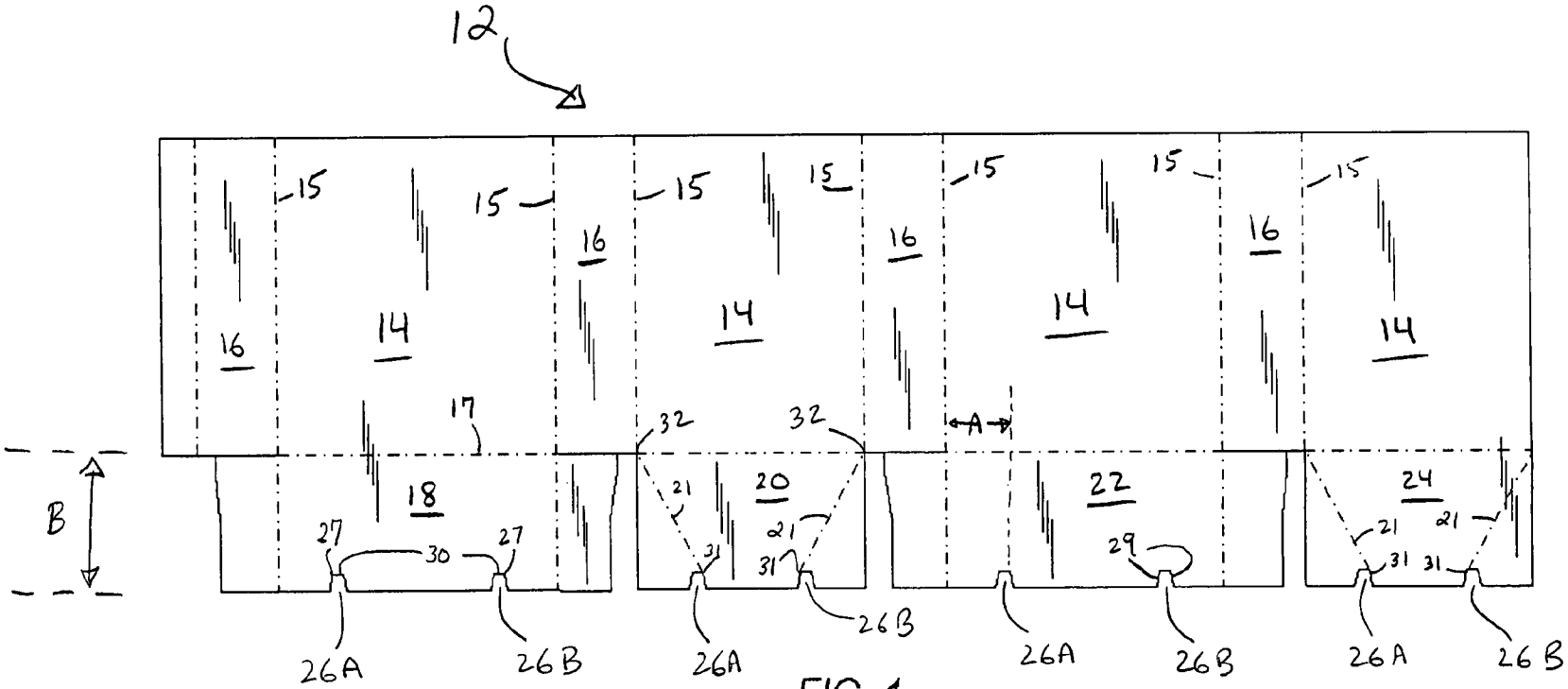
FIG. 1 is a plan view of a blank for forming a carton in accordance with the present invention.

As shown in the drawings, the present invention is directed to a carton 10 formed from a blank 12, which includes a locking mechanism. Referring to FIG. 1, the blank comprises a plurality of foldable side panels 14 connected by parallel score lines 15 and, in the case of an octagonally shaped carton as shown, a plurality of smaller foldable side panels 16 between the larger foldable side panels 14. Although the drawings show an octagonal shaped carton, the locking mechanism of the invention may be used in cartons having many different shapes and sizes. For example, other polygonal shaped cartons employing the locking mechanism of the invention may be formed by using a different number of foldable side panels, such as four, eight or sixteen side panels.

Bottom panels 18, 20, 22, 24 are foldably connected to each of the four larger foldable side panels 14, and interact with each other to lock the foldable side panels in place when the bottom panels are folded upon each other along fold lines 17 to form the carton. A separate generic cap or top (not shown) may be used to cover the open end of the carton after it is formed. Alternatively, top panels similar to the bottom panels shown may be employed to provide a flat top with a locking mechanism. Thus, although the locking mechanism is shown and described herein in connection with bottom panels of a container, the locking mechanism of the invention may also be employed in the top panels of a carton, or any other end closure.

Each of the bottom panels 18, 20, 22, 24 are provided with spaced apart notches 26A, 26B. The positioning of the notches is chosen so that the notches 26A may interlock with notches 26B on adjacent bottom panels when the carton is formed. For example, notch 26A in bottom panel 20 interlocks with notch 26B in bottom panel 18. To ensure proper alignment and locking of the notches, each notch 26A, 26B should be positioned substantially the same distance from the parallel fold lines 15. For example, in the blank shown in FIG. 1, the distance A between the lower outer corner 27 of each notch and the closest parallel fold line 15 is 16 13/16 inches. When fully assembled (see FIG. 5), the carton bottom has a hole 28 centrally located between the bottom panels 18, 20, 22, 24. The size of the hole may be changed by adjusting the position of the notches along the outer edge of bottom panels. For example, as the distance A increases, such that the notches are moved toward the center of the bottom panels, the size of the centrally located hole formed by the bottom panels will decrease. Similarly, as the distance A decreases, the size of the hole increases. The position of the notches along the edge of the bottom panels is also dependent on the length of the bottom panels (i.e., the distance B from the from the outer edge of the bottom panels to the fold line 17). As the length B increases, the notches will have to be moved more toward the center, such that the distance A increases.

The notches are formed from cut lines in the outer edge of the bottom panels and are shown in the annexed drawings as having a generally rectangular shape having tapered side edges 29. However, the notch can be cut into any shape that permits interlocking with an adjacent notch, for example, the notches may have an oval, square, U-shape or other non-liner shape. In a preferred embodiment (as shown), the notch is tapered such that the mouth of the notch at the edge of the bottom panel is larger than the base 30 of the notch. This provides additional frictional locking as described below. The size of the notch depends on the thickness of the paperboard, and is generally increased when the thickness of the paperboard is increased. For example, in the blank shown in FIG. 1, the base of the notch is approximately 1¼ inch wide and the mouth of the notch is approximately 1¾ inch wide. However, the notch size can vary in width from 1½-3 inches depending on the application.

Opposing bottom panels 20 and 24 further include two diagonal score lines 21, each extending from an interior edge 31 of notches 26A, 26B to the closest corner 32 formed by fold lines 15, 17, to facilitate interlocking of notches 26A, 26B, as described below.

Figure 2:
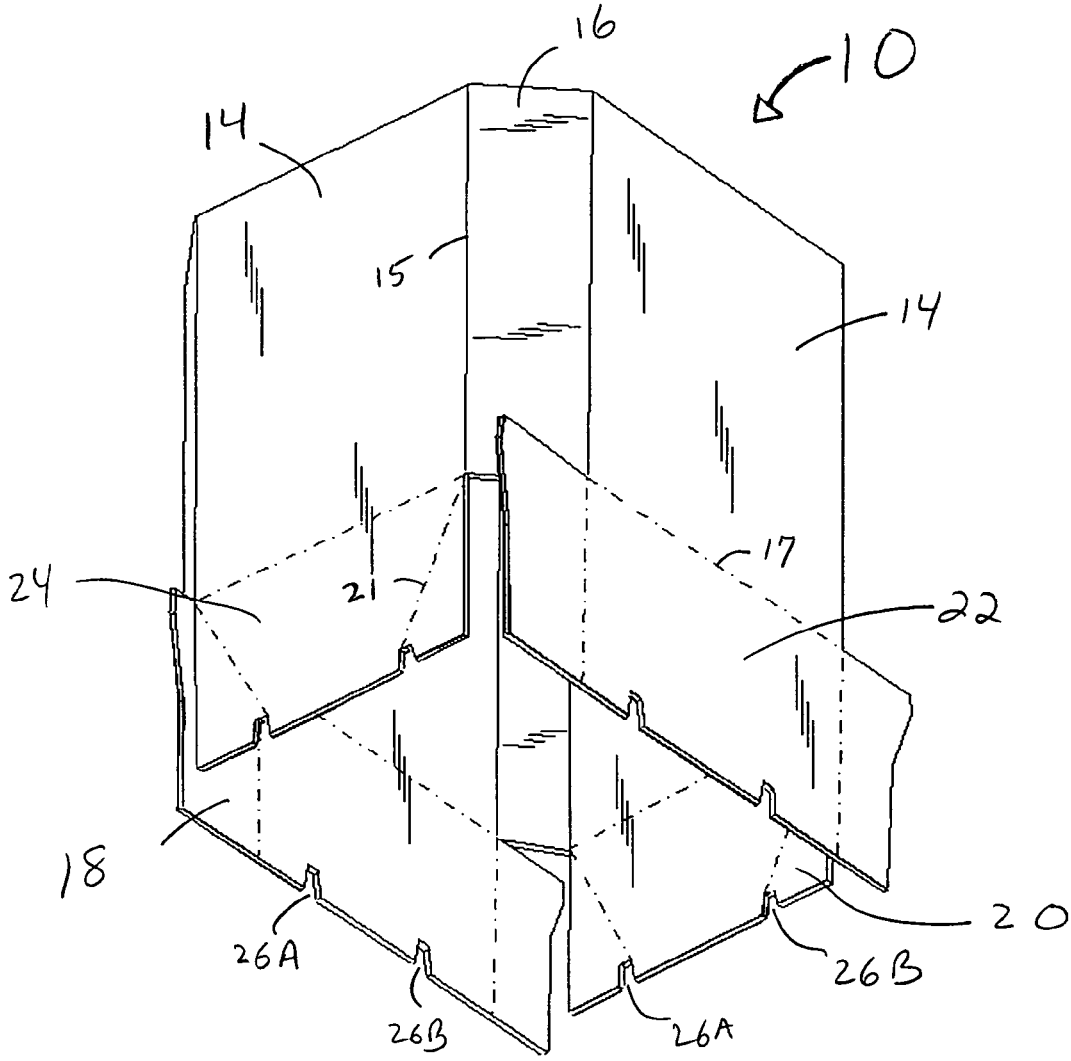
FIG. 2 is a perspective view of a carton employing the locking mechanism of the invention with the end panels open.
Figure 3:
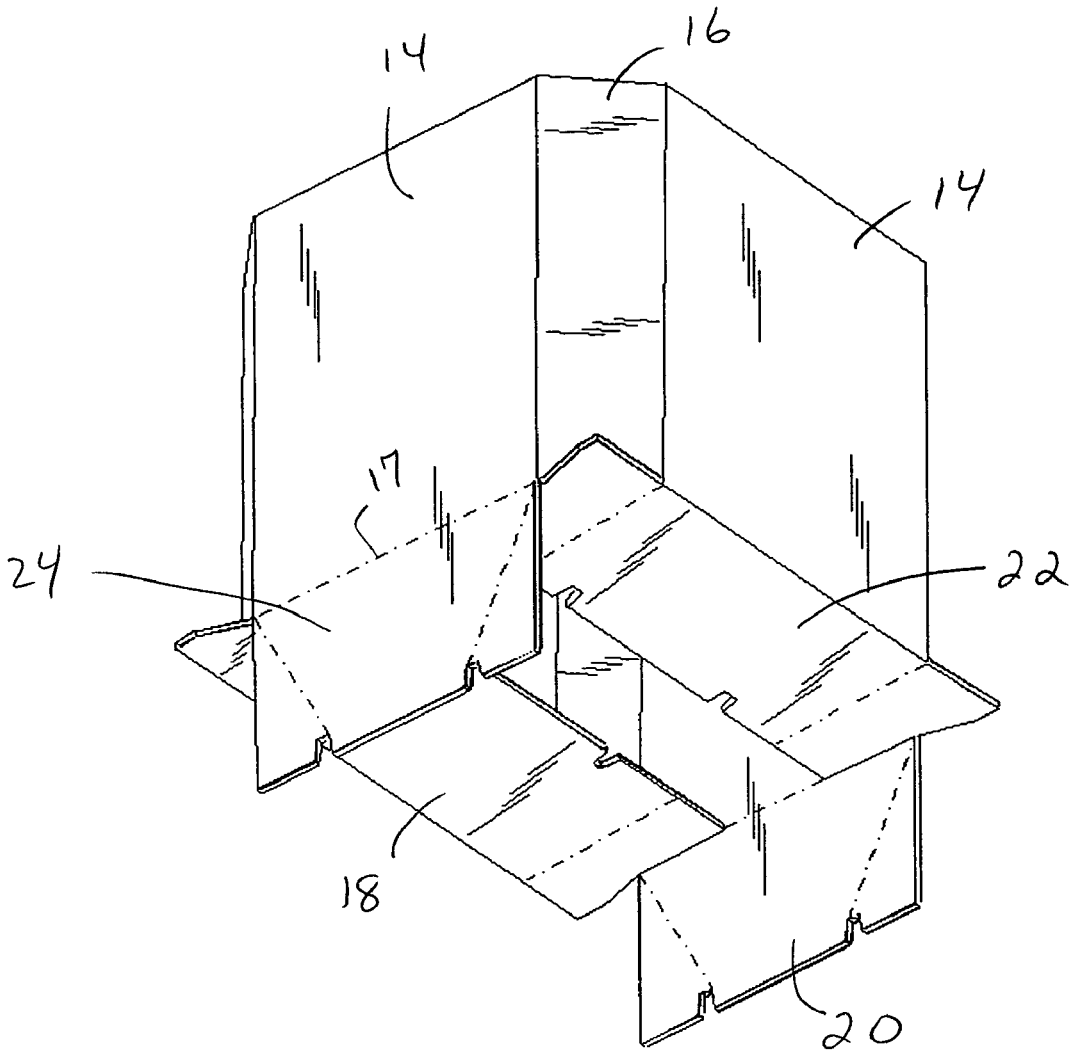
FIG. 3 is a perspective view of the carton of FIG. 2 with two end panels folded over.
Figure 4:
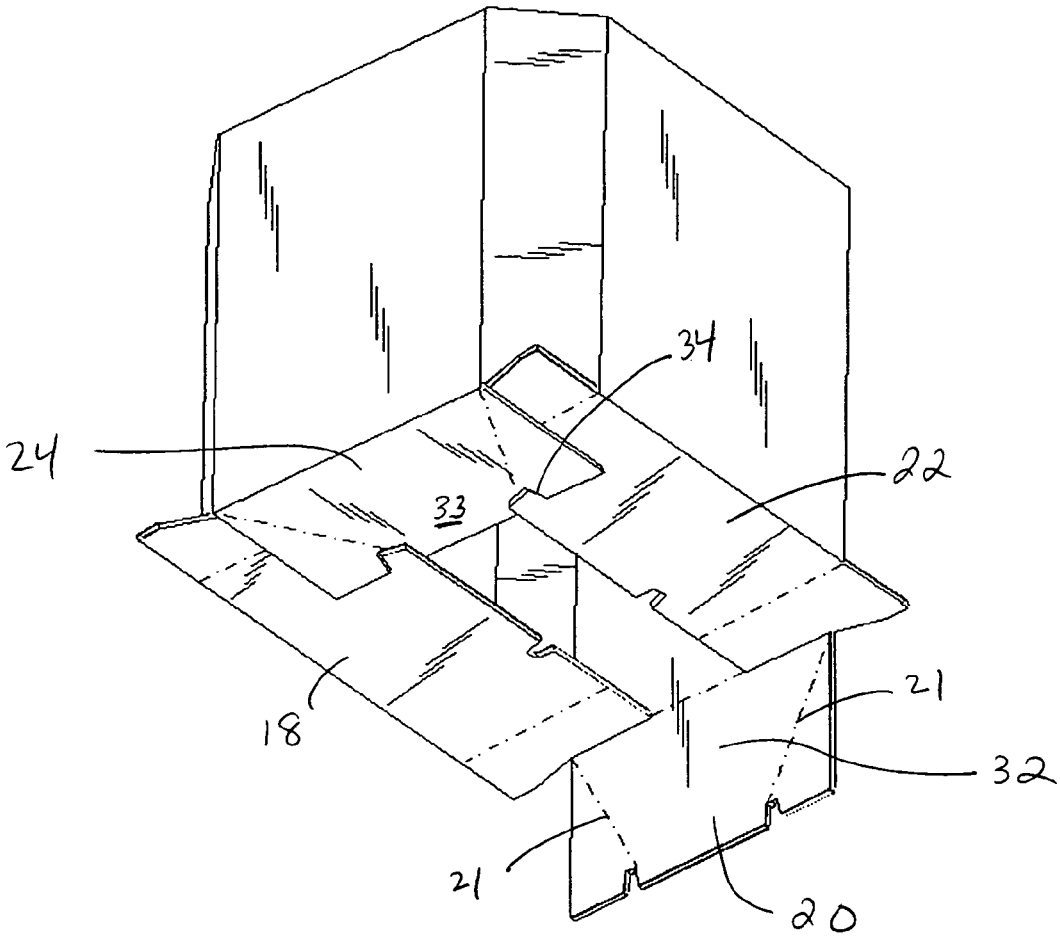
FIG. 4 is a perspective view of the carton of FIG. 2 with a third end panel folded over and locked in place.
Figure 5:
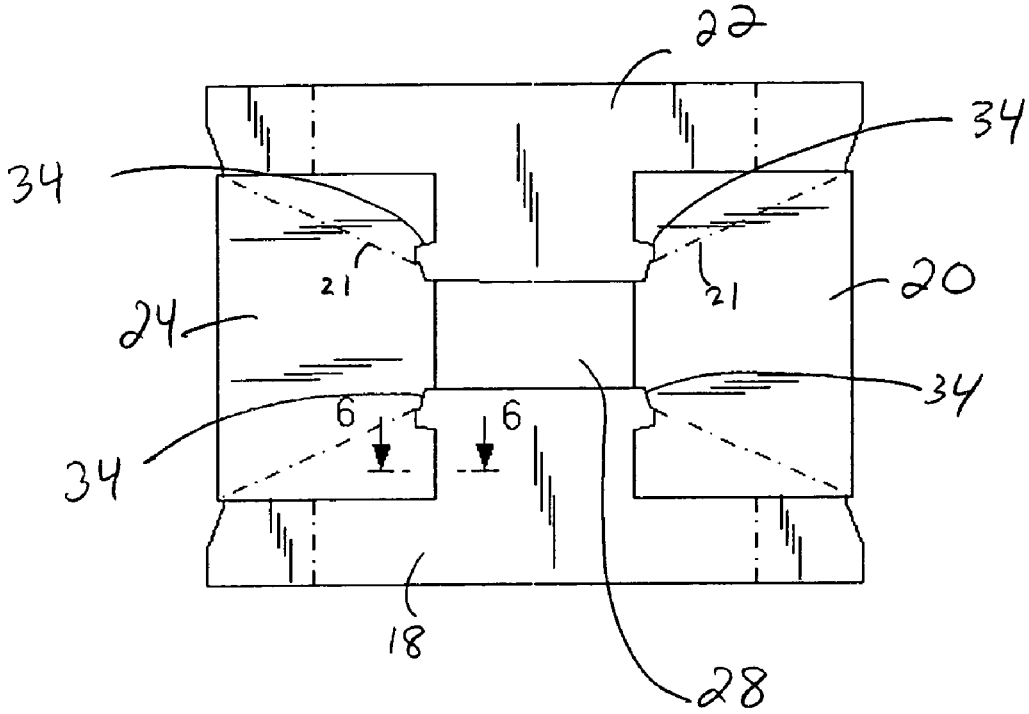
FIG. 5 is a bottom view of the carton of FIG. 2 with all end panels folded over and locked in place to form a locked end closure.
Figure 6:
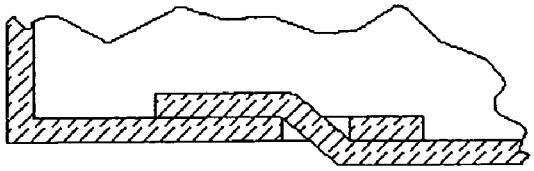
FIG. 6 is a cross-sectional view of the end panels in the folded and locked position taken along the line 6-6 in FIG. 5.

In operation, when the foldable side panels 14 are folded together to form a container (see FIG. 2), the bottom panels 18, 22 are folded downwardly, followed by bottom panels 20 and 24, respectively (see FIGS. 3-5). The central portion 33 of bottom panels 20, 24 (between the diagonal score lines 21) is then pushed downward to enable the notch 26A of one bottom panel to engage the notch 26B of an adjacent bottom panel and frictionally lock the respective panels together at a double-notch locking junction 34 (see FIGS. 5-6). The diagonal score lines 21 provide sufficient movement of the end panels' 20, 24 central portion to enable the notches to interlock, and the tapered side edges of each notch provide sufficient room at the mouth for interlocking, and increased frictional engagement as the bottom panels 20, 24 return to the un-depressed location. Similar double-notch locking junctions 34 are obtained by similar interactions at each of the notches 26A, 26B.

The resulting locking junctions 34 are easily formed and provide a secure lock even when handled roughly. Because the locking junction applies force in two directions, the effects of folding and diagonal score memory are reduced, as well as the chances of tearing on the flanges.

Although the invention has been described with reference to preferred embodiments, it will be appreciated by one of ordinary skill in the art that numerous modifications are possible in light of the above disclosure. For example, the locking mechanism of the present invention may be used with other board combinations and on the top panels as well as the bottom panels, to minimize the size of each panel. All such variations and modifications are intended to be within the scope and spirit of this invention.

We claim:

1. A carton, comprising a plurality of side panels hingedly joined together by respective first lines;

a plurality of end panels, each end panel being hingedly joined along a hinged edge thereof to one of said side panels, respectively, by a respective second line, wherein said end panels each having a free edge opposite said hinged edge and a locking mechanism comprising a plurality of notches formed in said free edge of each panel of at least two opposed pairs of the end panels, each of the notches being positioned in the free edge such that when the side panels are folded to form the carton and the end panels are folded over, one of the notches from each of the end panels interlocks with one of the notches from an adjacent one of the end panels to form notch locking junctions, and at least one diagonal line extending from at least one edge of at least one of said notches in at least one set of opposing said end panels to an outer corner formed by an intersection of one of the respective first lines closest to a respective at least one of said notches and the respective second line to facilitate interlocking of the notches.

2. The carton according to claim 1, wherein the notches are substantially rectangular in shape.

3. The carton according to claim 1, wherein the notches have tapered sides.

4. The carton according to claim 1, wherein the notches are substantially rectangular in shape and have tapered sides.

5. The carton according to claim 1, wherein each of the notches are the same size.

6. The carton according to claim 1, wherein said diagonal line is a diagonal score line.

7. The carton according to claim 1, wherein said diagonal line extends from at least one interior edge of the_at least one notch.

8. The carton according to claim 1, wherein said first lines are substantially perpendicular to said second lines.

9. The carton according to claim 1, wherein each notch is positioned in the free edge an equal distance from one of the first lines closest to a respective one of the notches.

10. The carton according to claim 1, wherein the first lines are parallel to one another.

11. The carton according to claim 1, wherein the end panels remain substantially planar during and after folding of the end panels to interlock them together.

12. The carton according to claim 1, wherein the number of side panels in the carton is selected from the group consisting of four, eight, and sixteen.

13. The carton according to claim 1, wherein the number of side panels is at least four.

14. The carton according to claim 13, wherein the notches are formed in only four of the end panels.

15. The carton according to claim 14, wherein each of the end panels having the notches opposes another of the end panels having the notches.

16. An end closure system for a carton having side panels and end panels hingedly joined together by first lines, each of the end panels having a free edge and a hinged edge attached to one of the respective side panels, the system comprising notches formed in the free edge of each of at least two opposed pairs of the end panels such that when the side panels are folded to form the carton and the opposed end panels are folded over, one of the notches from one each of the opposed end panels interlocks with one of the notches from an adjacent one of the opposed end panels to form notch locking junctions; and at least one diagonal line extending from at least one edge of at least one of said notches in at least one set of opposing said end panels to an outer corner formed by an intersection of one of the respective first lines closest to a respective at least one of said notches and the respective second line to facilitate interlocking of the notches.

* * * * *